US010760314B1

(12) United States Patent
Stryffeler

(10) Patent No.: US 10,760,314 B1
(45) Date of Patent: Sep. 1, 2020

(54) BOXCAR PLUG DOOR ROLLER ALIGNMENT SYSTEM

(71) Applicant: Adam Stryffeler, Salem, OH (US)

(72) Inventor: Adam Stryffeler, Salem, OH (US)

( * ) Notice: Subject to any disclaimer, the term of this patent is extended or adjusted under 35 U.S.C. 154(b) by 0 days.

(21) Appl. No.: 16/513,096

(22) Filed: Jul. 16, 2019

Related U.S. Application Data

(60) Provisional application No. 62/698,505, filed on Jul. 16, 2018.

(51) Int. Cl.
*E05D 15/00* (2006.01)
*E05D 15/06* (2006.01)

(52) U.S. Cl.
CPC ..... *E05D 15/0621* (2013.01); *E05Y 2900/51* (2013.01)

(58) Field of Classification Search
CPC . Y10T 16/364; Y10T 16/384; Y10T 16/3825; Y10T 16/3837; E05D 15/0621; E05D 15/063; E05D 15/0634; E05D 15/0665; E05Y 2900/51
See application file for complete search history.

(56) References Cited

U.S. PATENT DOCUMENTS 3,237,238 A * 3/1966 Anderson ..... E05D 15/0669 16/105
3,698,036 A * 10/1972 Goodman ..... E05D 15/0665 16/100
4,109,847 A * 8/1978 Bailey ..... E05D 15/0669 228/119
4,194,266 A * 3/1980 Natzel ..... E05D 15/0669 16/32
4,282,631 A * 8/1981 Uehara ..... E05D 15/0665 16/102
5,678,280 A * 10/1997 Haab ..... E05D 15/0656 16/87.6 R
5,950,279 A * 9/1999 Chaput ..... A47H 1/08 16/105
6,370,734 B1 * 4/2002 Ryan ..... B61D 19/005 16/106
7,770,329 B2 * 8/2010 Hutnik ..... E05D 15/0669 49/410
7,962,998 B2 * 6/2011 Proctor ..... E05D 15/063 16/106
8,984,716 B2 * 3/2015 Proctor ..... E05D 15/063 16/97
2001/0054258 A1 * 12/2001 Becken ..... E05D 15/0669 49/409
2005/0012816 A1 * 1/2005 Becken ..... E05D 15/0665 348/107

* cited by examiner

*Primary Examiner* — Chuck Y Mah
(74) *Attorney, Agent, or Firm* — Richard Eldredge; Beth Felix

(57) ABSTRACT

A roller system includes a body forming a first housing, the first housing includes a cavity formed between a first sidewall and a second sidewall, the first sidewall extending parallel to the second sidewall; an opening configured to receive a bearing; a first abrasive protrusion secured to a first inner surface of the first sidewall; a second abrasive protrusion secured to a second inner surface of the second sidewall; and a shaft secured to and extending perpendicular to a wheel, the shaft is secured to the bearing.

1 Claim, 5 Drawing Sheets

BOXCAR PLUG DOOR ROLLER ALIGNMENT SYSTEM

BACKGROUND

1. Field of the Invention

The present invention relates roller systems, and more specifically, to a boxcar plug door roller alignment system.

2. Description of Related Art

Boxcars are well known in the art and are effective means to transport goods via the railway system. FIG. 1 depicts a side view of a boxcar 101 having a frame 103 that forms an inner area for storing goods therein. Access to the inner area is achieved via a movable door 105 slidingly engaged with a rail rigidly attached to the side of the frame 103. The door 105 rest on the rail via one or more roller assemblies 107, 103 that provide means for the door to roll along the rail.

FIG. 2 depicts a front cross-sectional view of the roller assembly 107 having a frame 201 that forms two housings 202, 204 that wheels 205 fit therein. The wheels 205 are rotatably attached to the frame 201 via bearings 207 rotatably attached to shafts 203 rigidly attaches to the frame 201.

One of the problems commonly associated with conventional roller assemblies is that the rods and/or roller bearings tend to deteriorate over time, which in turn creates pivoting play in the wheel alignment over time. Such play could cause failure and/or increase difficult in sliding the door 105 relative to the rails.

Although great strides have been made in the area of railcar brake assemblies, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
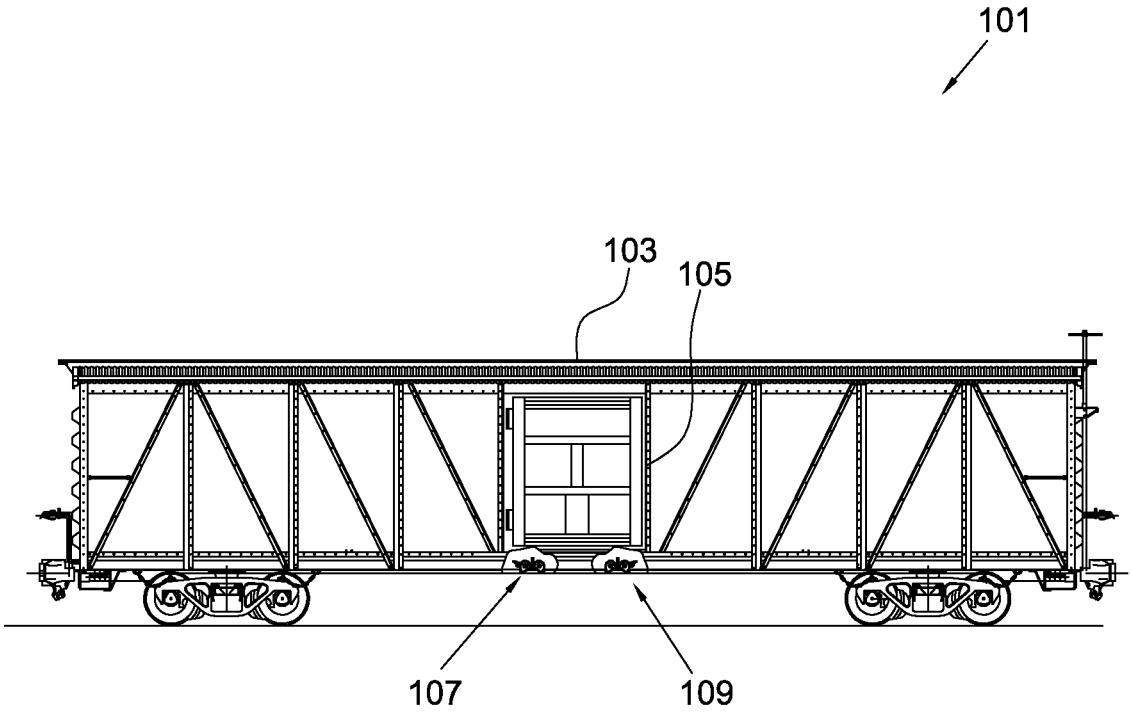
FIG. 1 (PRIOR ART)
FIG. 1 is a side view of a conventional box car.
Figure 2:
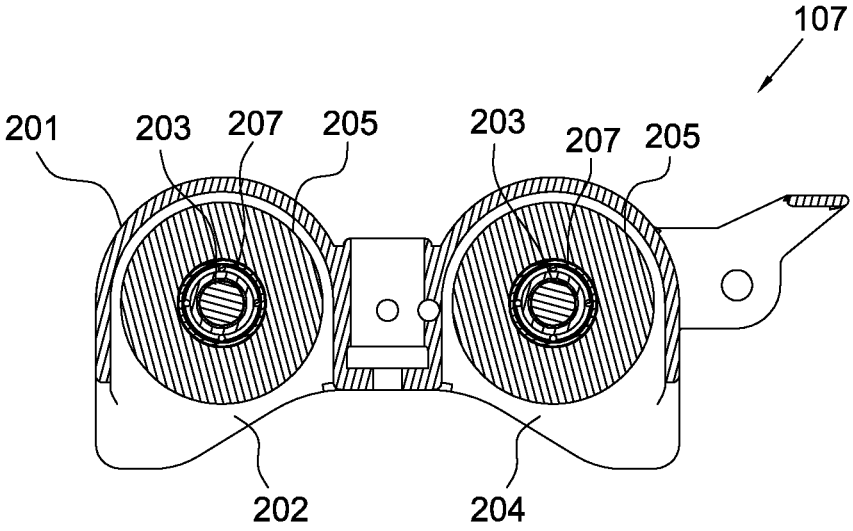
FIG. 2 (PRIOR ART)
FIG. 2 is a roller assembly of the box car of FIG. 1.
Figure 3:
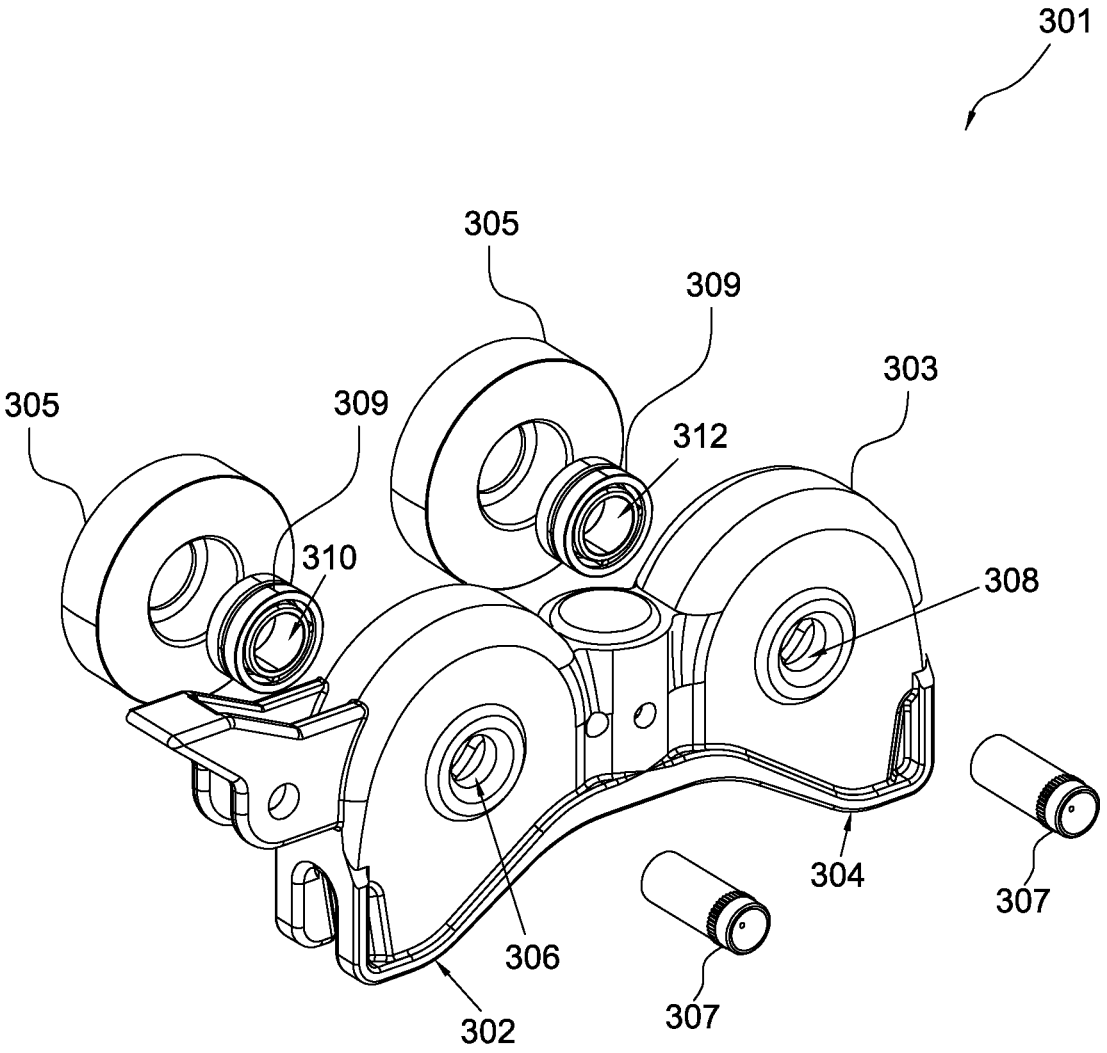
FIG. 3 is an oblique view of a roller system for a box car in accordance with a preferred embodiment of the present invention.
Figure 5:
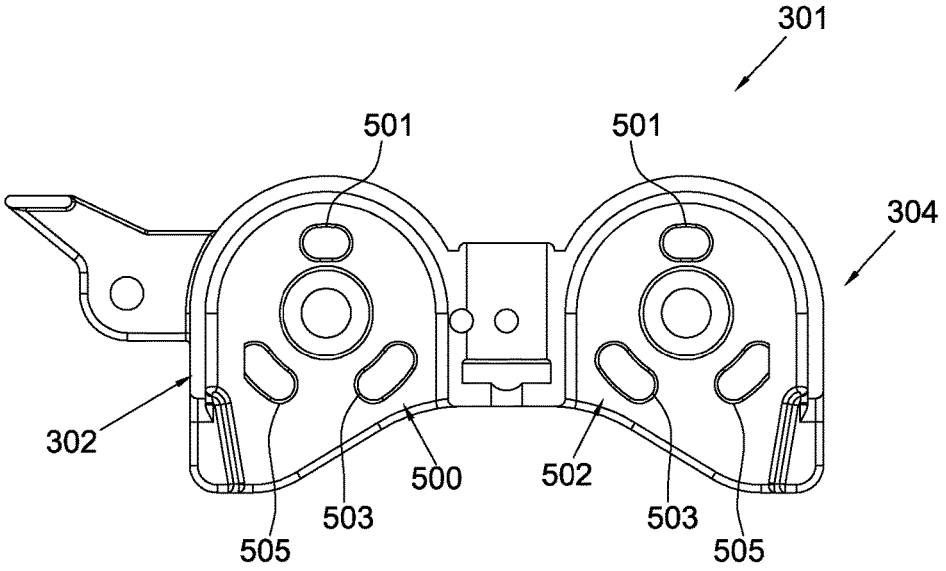
FIG. 5 is a cross-sectionals side view of the system of FIG. 4 taken at V-V.
Figure 4:
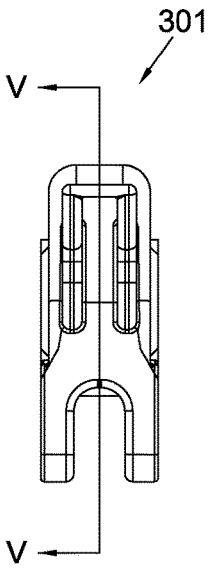
FIG. 4 is a front view of the system of FIG. 3.
Figure 6:
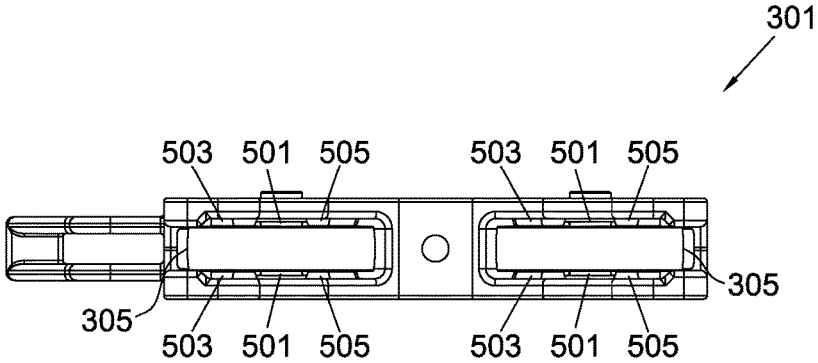
FIG. 6 is a bottom view of the system of FIG. 3.
Figure 7:
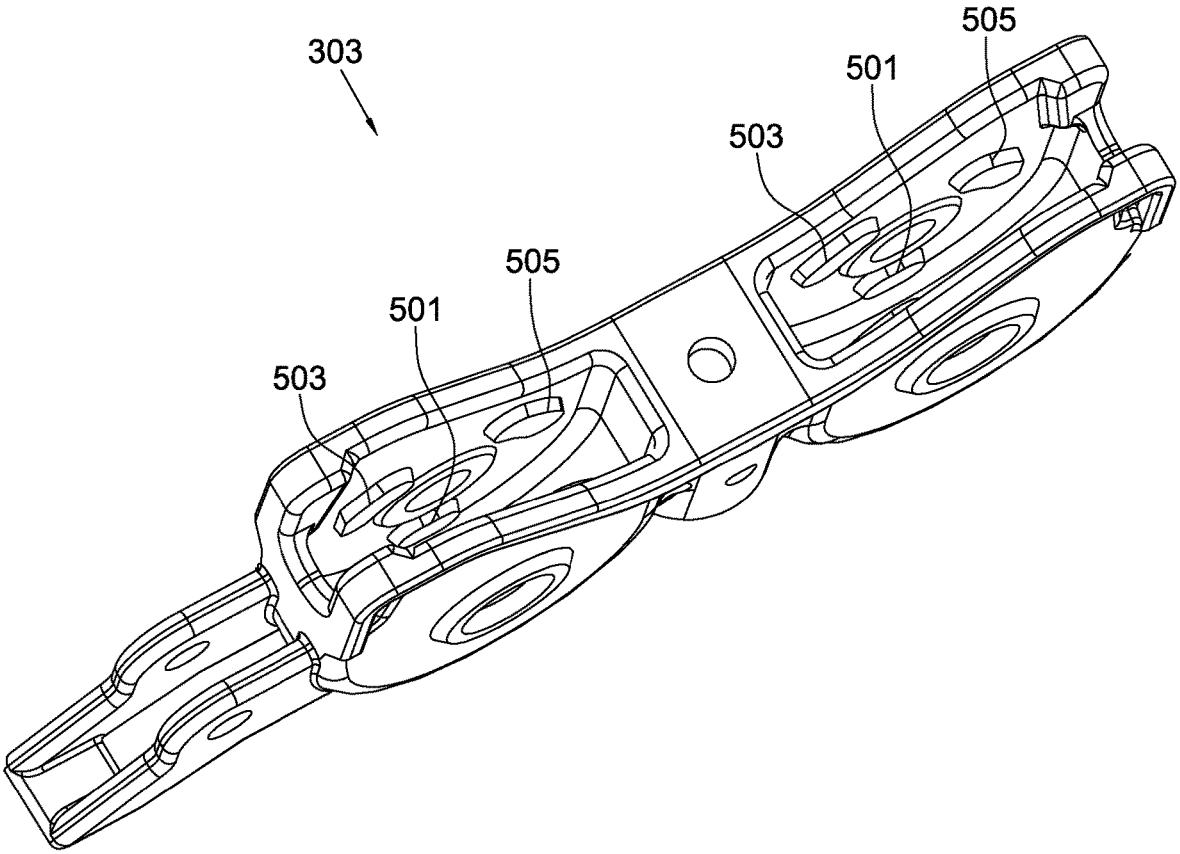
FIG. 7 is a top oblique view of the system of FIG. 3.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-7 depict various views of a roller system 301 in accordance with a preferred embodiment of the present application. It will be appreciated that system 301 overcomes one or more problems commonly associated with conventional roller assemblies for box cars.

In the preferred embodiments, the systems discussed herein are utilized with box cars; however, it will be appreciated that the features disclosed could be utilized with other types of vehicles and should not be narrowly tailored to protect only box cars.

In the contemplated embodiment, system 301 includes one or more of a frame 301 that forms two housings 302, 304 with inner areas configured to receive wheels 305 therein. Two openings 306, 308 extend through respective housings 302, 304 and are axially aligned with respective openings 310, 312 of the bearings 309 associated with each wheel 305.

A rod 307 extends through the openings of the housing and wheels and engage with the bearings. During use, the wheels rotate within the inner areas formed by the housing about the rods 307.

Figure 9:
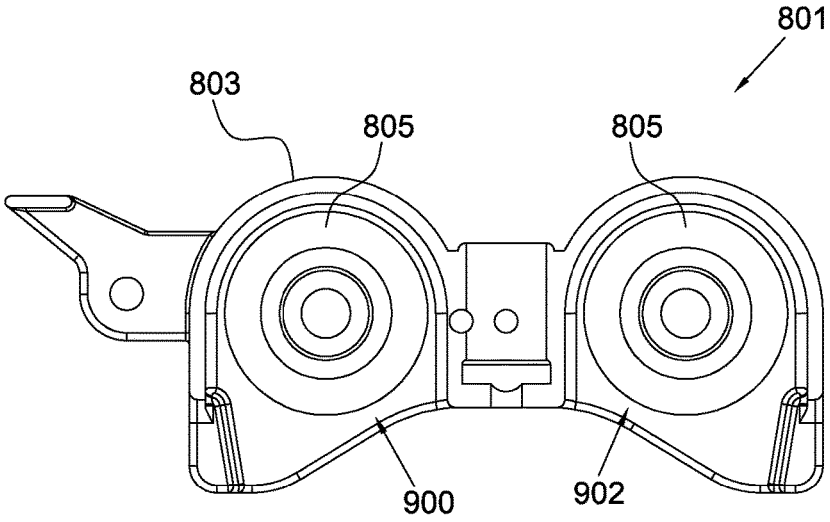
FIG. 9 is a cross-sectionals side view of the system of FIG. 8 taken at VIII-VIII.
Figure 8:
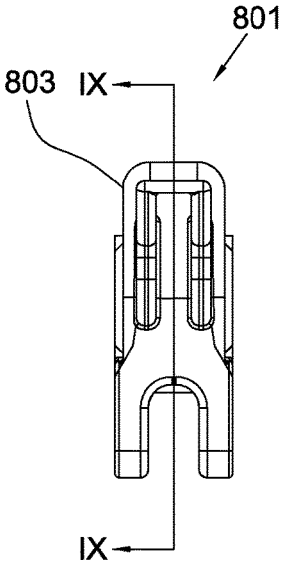
FIG. 8 is a front view of a roller system for a box car in accordance with an alternative embodiment of the present invention.

One of the unique features believed characteristic of the present invention is the use of a plurality of abrasive protrusions 501, 503, and 505 extending from inner surfaces 500 and 502 of respective housings 302, 304. When assembled, the wheels rest in a position between the protrusions and the inner surface of the housing walls. During use, pivoting play in the wheels when come into contact with the protrusion, which in turn will keep the wheels in a general desired alignment. In one embodiment, the protrusions can be removably attached to the inner walls for ease of maintenance. In yet another embodiment, it is contemplated having a continuous protrusion disposed between the inner wall of the housing and the side of the wheel. Such features are found in FIGS. 8 and 9.

System 801 is substantially similar in form and function to system 301 and incorporates one or more of the features discussed above. In the contemplated embodiment, the system 801 includes a frame 803 with the protrusions 805 extending from inner surfaces 900, 902 of the housings. It should be appreciated that in the contemplated embodiment the protrusion are disc shaped in lieu of the separated protrusions discussed above.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A roller system, comprising:

a body forming a first housing, the first housing having:
- a cavity formed between a first sidewall and a second sidewall, the first sidewall extending parallel to the second sidewall;
- an opening configured to receive a bearing;

a first abrasive protrusion secured to a first inner surface of the first sidewall;

a second abrasive protrusion secured to a second inner surface of the second sidewall; and a shaft secured to and extending perpendicular to a wheel, the shaft is secured to the bearing;

wherein the wheel is disposed between the first abrasive protrusion and the second abrasive protrusion; and wherein the wheel comes into contact with the first abrasive protrusion solely with tilting movement of the body relative to the wheel.

* * * * *